US012746445B1

(12) United States Patent
Sears

(10) Patent No.: US 12,746,445 B1
(45) Date of Patent: Sep. 29, 2026

(54) FOOTBALL SNAP TRAINING DEVICE WITH MOTORIZED BALL RETRACTION SYSTEM

(71) Applicant: Corey A. Sears, Hutto, TX (US)

(72) Inventor: Corey A. Sears, Hutto, TX (US)

( * ) Notice: Subject to any disclaimer, the term of this patent is extended or adjusted under 35 U.S.C. 154(b) by 0 days.

(21) Appl. No.: 19/392,093

(22) Filed: Nov. 17, 2025

(51) Int. Cl.
*A63B 69/00* (2006.01)

(52) U.S. Cl.
CPC ..... *A63B 69/002* (2013.01); *A63B 2220/13* (2013.01); *A63B 2225/50* (2013.01); *A63B 2243/007* (2013.01)

(58) Field of Classification Search
CPC ..... A63B 69/002
USPC ..... 473/422, 438, 441, 442, 443, 444, 445
See application file for complete search history.

(56) References Cited

U.S. PATENT DOCUMENTS

| | | | | | |
|---|---|---|---|---|---|
| 2,521,649 | A * | 9/1950 | Paupa | A63B 69/34 | 473/445 |
| 2,940,757 | A * | 6/1960 | Britt | A63B 69/34 | 473/445 |
| 3,044,776 | A | 7/1962 | Weidmaier | | |
| 3,674,265 | A * | 7/1972 | Sheets | A63B 69/34 | 473/441 |
| 3,700,238 | A | 10/1972 | Mathis | | |
| 4,477,076 | A | 10/1984 | Monaco | | |
| 4,906,001 | A | 3/1990 | Vaughn | | |
| 5,474,290 | A * | 12/1995 | Rascona | A63B 21/4047 | 473/441 |
| 6,045,464 | A | 4/2000 | Crist | | |
| 6,050,906 | A | 4/2000 | Stout | | |
| 6,718,961 | B1 | 4/2004 | Woods | | |
| 7,063,647 | B2 * | 6/2006 | Harney | A63B 22/025 | 482/4 |
| 7,125,349 | B2 | 10/2006 | Tucker | | |
| 7,527,568 | B2 * | 5/2009 | Joseph | A63B 69/32 | 473/422 |
| 8,460,130 | B1 | 6/2013 | Earle | | |
| 8,932,156 | B2 | 1/2015 | Boehner | | |
| 8,979,548 | B2 * | 3/2015 | Guttler | A63B 69/0053 | 434/247 |
| 10,265,598 | B1 | 4/2019 | Gagne | | |
| 11,904,221 | B2 | 2/2024 | Nee | | |
| 2006/0035733 | A1 | 2/2006 | Silver | | |
| 2006/0035734 | A1 | 2/2006 | Borunda | | |

* cited by examiner

*Primary Examiner* — Joseph B Baldori
(74) *Attorney, Agent, or Firm* — Buche Law Firm, P.C.; Bryce Johnson; John Buche

(57) ABSTRACT

A portable football snap training device includes a body on legs, a spine supporting a neck that moves linearly relative to the body, a motorized linear drive powered by a battery and controlled by onboard electronics with wireless remote activation, and a strap that secures a regulation football at a bent distal neck portion so the ball hovers near ground level in a ready state; upon activation the drive rapidly retracts the neck to move the ball in a snap-simulating motion visible from 360° to train defensive reaction timing, with embodiments including automatic or spring-assisted reset, optional random-timing mode, and a wireless receiver/transmitter module.

2 Claims, 10 Drawing Sheets

FOOTBALL SNAP TRAINING DEVICE WITH MOTORIZED BALL RETRACTION SYSTEM

CROSS-REFERENCE TO RELATED APPLICATIONS

See Application Data Sheet (ADS).

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The present invention relates generally to football training apparatus and, more particularly, to a portable football snap simulator device that utilizes an actual football secured to a motorized telescoping mechanism to simulate realistic ball movement for training defensive players in reaction timing and get-off techniques.

Listing of the Prior Art

The following references might be to be related to the disclosed subject matter:

- U.S. Pat. No. 4,477,076, issued Oct. 16, 1984, to inventor Robin Monaco, is titled "Defensive Reaction Football Blocking Device."
- U.S. Pat. No. 6,050,906, issued Apr. 18, 2000, to inventors Ryan L. Stout, Christopher A. Stout, and Robert M. Fresques, is titled "Mechanical Football Centering Device."
- U.S. Pat. No. 4,906,001, issued Mar. 6, 1990, to inventor Donald E. Vaughn, is titled "Football Centering Device."
- U.S. Pat. No. 3,044,776, issued Jul. 17, 1962, to inventors Vernon C. Weidmaier and Samuel J. Nicolino, is titled "Football Training Device."
- U.S. Pat. No. 6,045,464, issued Apr. 4, 2000, to inventor Michael A. Crist, Jr., is titled "Football Snap Simulator."
- U.S. Pat. No. 3,700,238, issued Oct. 24, 1972, to inventor Buddy H. Mathis, is titled "Offensive Training Coordinator."
- U.S. Pat. No. 10,265,598 B1, issued Apr. 23, 2019, to inventor Adam Gagne, is titled "Football Snapper."

- U.S. Pat. No. 6,718,961 B1, issued Apr. 13, 2004, to inventors Ronald J. Woods and Nicholas Fayo, is titled "Football Launcher."
- US 2006/0035733 A1, published Feb. 16, 2006, to inventors Duane Silver and Connie Silver, is titled "Football Hiking System."
- U.S. Pat. No. 8,460,130 B1, issued Jun. 11, 2013, to inventor James Earle, is titled "Football Snap Aid."
- US 2006/0035734 A1, published Feb. 16, 2006, to inventor William C. Borunda, is titled "Football Sled."
- U.S. Pat. No. 8,932,156 B2, issued Jan. 13, 2015, to inventor Douglas L. Boehner, is titled "System and Method to Pitch Footballs."
- U.S. Pat. No. 11,904,221 B2, issued Feb. 20, 2024, to inventor John Nee, is titled "Football Snap Receiving Training Device and Method of Use."
- U.S. Pat. No. 7,125,349 B2, issued Oct. 24, 2006, to inventor Calvin Tucker, is titled "Shotgun Hiker."

See the Information Disclosure Statements (IDS) of record.

Background of the Invention

The development of proper defensive reaction timing is critical to the success of football players, particularly defensive linemen and linebackers. In actual game conditions, defensive players must react instantaneously to the movement of the football as it is snapped by the offensive center. Any premature movement results in an offside penalty, while delayed reaction allows offensive players to gain positional advantage. This split-second timing is one of the most difficult skills to develop in football training.

Traditionally, defensive reaction training has been conducted using one of several inadequate methods. Many coaches initiate defensive drills using audible countdown signals similar to offensive snap counts, a practice that trains players to respond to sound rather than visual movement. This approach is counterproductive since defensive players must react to what they see on the field, not what they hear. While live snap drills using a full offensive line setup provide realistic training conditions, these drills are resource-intensive, time-consuming to organize, and provide limited repetitions due to the need for offensive players to reset between each snap. Some training equipment incorporates snap simulation features into comprehensive blocking sleds; however, these systems suffer from several disadvantages including high cost, lack of portability, mechanical complexity, and inability to function independently of the larger apparatus.

One type of snap simulator is taught by U.S. Pat. No. 6,045,464 to Crist, Jr., titled "Football Snap Simulator," issued Apr. 4, 2000. This patent discloses a football training apparatus comprising a box-like housing with transparent windows, a motor with rotary shaft mounted inside the housing, thin panel cutouts shaped and painted to simulate the appearance of a football, the panels mounted on the motor shaft for rotary arcuate movement, a spring connected between the panel and housing to bias the panel to a home position, remote control operation via wireless transmitter and receiver, and capability to be mounted on a blocking sled or used free-standing.

While the Crist device achieves the functional goal of simulating snap movement for defensive training, it suffers from several significant limitations. The Crist device uses thin panel cutouts that are merely painted to look like footballs; these two-dimensional representations move arcuately in a rotational plane and do not provide the realistic three-dimensional movement characteristics of an actual football being snapped. The arcuate rotational movement of flat panels in the Crist device does not accurately replicate the linear forward-and-upward motion of a football during an actual snap from center. Players viewing painted panel cutouts through windows do not experience the same visual stimulus as seeing an actual football move, and the brain processes these differently, potentially reducing training effectiveness. The Crist device provides no opportunity for players to interact with an actual football, missing the tactile and dimensional feedback that enhances training realism. Additionally, the housing-based design with windows creates a bulky enclosure that obscures portions of the simulated ball movement and limits viewing angles.

There exists a substantial and unmet need in football training for a device that utilizes an actual football rather than a two-dimensional representation to provide authentic visual stimuli, creates realistic linear ball movement that accurately simulates the motion of a football being snapped by a center, provides 360-degree visibility of the football from all angles without visual obstruction by housing walls, offers true-to-game positioning with the football suspended just above ground level matching actual center snap positioning, maintains portability and ease of use for deployment at various practice locations, operates with wireless remote control to allow coaches optimal viewing positions for evaluating player reactions, functions as a standalone training device without requiring integration into larger apparatus, and achieves these improvements while remaining cost-effective for programs with limited budgets. The present invention addresses all of these needs through a novel structural configuration utilizing a motorized telescoping mechanism that moves an actual football in realistic snap-simulating motion.

SUMMARY OF THE INVENTION

The present invention provides a football snap training device, hereinafter sometimes referred to as the "Snapping Turtle," that overcomes the limitations of prior art by utilizing an actual football secured to a motorized telescoping or piston-driven arm mechanism. The device simulates realistic football snap movement to train defensive players in proper reaction timing.

The preferred embodiment of the invention comprises a main body structure consisting of a generally cylindrical housing supported by four leg members extending downward to contact the ground surface, wherein the cylindrical body has a spine that serves as the primary structural component and contains the motorized drive mechanism, power supply, and electronic control systems. A reciprocating neck assembly comprising a piston drive (or telescoping drive) extends and retracts the neck incrementally from the main body (e.g., similar to a turtle neck), with the neck set upon a baring slide for lower-friction movements. The bearing slide is supported on the a spine that may be a steel tube having an approximate diameter of 2 inches, suitably, the neck may be bent upward at an exposed end from the body where a football maybe attached. A ball securing mechanism comprising (in a preferred embodiment) a strap with buckle or other fastening means secures an actual regulation football to the extended end of the telescoping neck assembly, positioning the football to hover just above ground level and thereby replicating the position of a football held by an offensive center prior to snap. A motorized drive system comprising a 12-volt DC motor with piston drive mechanism is housed within the main cylindrical body and can be supported on the floor of the body or by the spine, the motor being operatively connected to drive the and neck assembly in linear extension and retraction motion, causing the secured football to move rapidly in a manner simulating the snap motion of a football. An electronic control system comprising an electronics box contains a wireless receiver, on/off switch components, battery power management circuitry, and optionally a wireless transmitter for bi-directional communication, the system receiving wireless control signals from a remote transmitter device. A power supply comprising a 12-volt rechargeable or replaceable battery is housed within the main body and electrically connected to power the motor and electronic control components. A carrying handle attached to the top surface of the main body facilitates portability and transport of the device. A four-leg support structure comprising four legs fabricated from steel tube of approximately 1-inch diameter extends downward from the main body and is positioned to provide stable ground contact and support.

In operation, a coach or trainer positions the device on a practice field with the football extending from the neck assembly, defensive players assume set positions facing the device, and the coach operates a wireless remote transmitter from an optimal viewing location. Upon activation, the motor drives the telescoping mechanism to rapidly retract the neck assembly into the main body, causing the secured football to move in a quick "snapping" motion that provides authentic visual stimulus for training defensive reaction timing. The retraction of the telescoping neck into the cylindrical body creates a biomechanical analogy to a turtle's head retreating into its shell, which (along with the body and four legs) inspired the "Snapping Turtle" designation for the device.

In another mode of operation, a player or group of players, without a coach or trainer, positions the device on a practice field with the football extending from the neck assembly, defensive players power on the snapping turtle and set a "random" snap operation. Next, the players assume set positions facing the device, and the random "snap" generator activates. Upon activation, the motor drives the telescoping mechanism to rapidly at random times with reset periods to simulate e.g. a gameday play-clock or at timeframes that allow a short get-off sprint with required hustle to reset before another random snap occurs. At such "random" times, the motor retracts the neck assembly into the main body, causing the secured football to move in a quick "snapping" motion that provides authentic visual stimulus for training defensive reaction timing.

Using a real football and linear retraction better matches game conditions than arcuate panel simulators, while portability, simple tubular framing, and internalized components make the device cost-effective, durable, and easy to deploy independently of blocking sleds. Thus, the present invention provides substantial advantages over the Crist device and other prior art. By securing and moving a real football rather than a painted representation, the invention provides authentic visual and spatial cues that match game conditions. The telescoping mechanism creates realistic linear motion that accurately simulates how a football moves during an actual snap, rather than the arcuate rotational movement of flat panels. The open structural design allows players positioned at any angle around the device to clearly observe the football movement without visual obstruction by housing walls or windows, providing unobstructed 360-degree visibility. The football is suspended just above the ground at the height and position where an offensive center would hold the ball, providing authentic ground-level positioning and true-to-game training conditions. The football moves through three-dimensional space in a manner that closely replicates actual snap motion, engaging players' visual processing systems the same way game conditions do and providing realistic three-dimensional movement. The body and frame design with internal components is simple to manufacture, maintain, and repair compared to the Crist housing systems, offering simplified structural design. The lightweight tubular construction with integrated handle facilitates easy transport and repositioning during practice sessions, providing enhanced portability. These and other advantages and features of the invention will become apparent from the detailed description of the drawings and the preferred embodiment that follows.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which.

In the figures, the following components of the preferred embodiment are shown in connection with the corresponding reference numeral identified below.

- 1000 snap-simulator machine
  - 1100 Body
    - 1110 Legs (1" steel tube)
    - 1120 Spine (2" steel tube)
      - 1121 Bearing slide
      - 1122 Motor (12V Motor with piston drive)
        - 11220 piston drive
      - 1123 Electronic Box (on/off switch—wireless receiver and/or transmitter)
        - 11230 wireless receiver and/or transmitter module
      - 1124 Battery (12V Battery)
  - 1200 Neck (¼"×2" steel bar ben upward)
  - 1300 Strap (including buckle or other fastening and tightening mechanism)
- 2000 Football (regulation football secured to neck assembly)

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

This is a specification of a football snap training device. The device simulates realistic football snap movement to train defensive players in proper reaction timing. A preferred embodiment comprises a generally cylindrical main body 1100 supported by four legs 1110, a longitudinal spine 1120, a bearing slide 1121 guiding a reciprocating or telescoping neck 1200, a 12-V motor 1122 driving a piston/linear mechanism 11220, an electronics box 1123 with on/off and wireless receiver (and optional transmitter 11230), a 12-V battery 1124, and a strap 1300 that secures a regulation football 2000 at a bent distal portion of the neck so the lowest point of the ball hovers a few inches above ground in the extended state. The details of the device are described below with reference to the figures.

Figure 1:
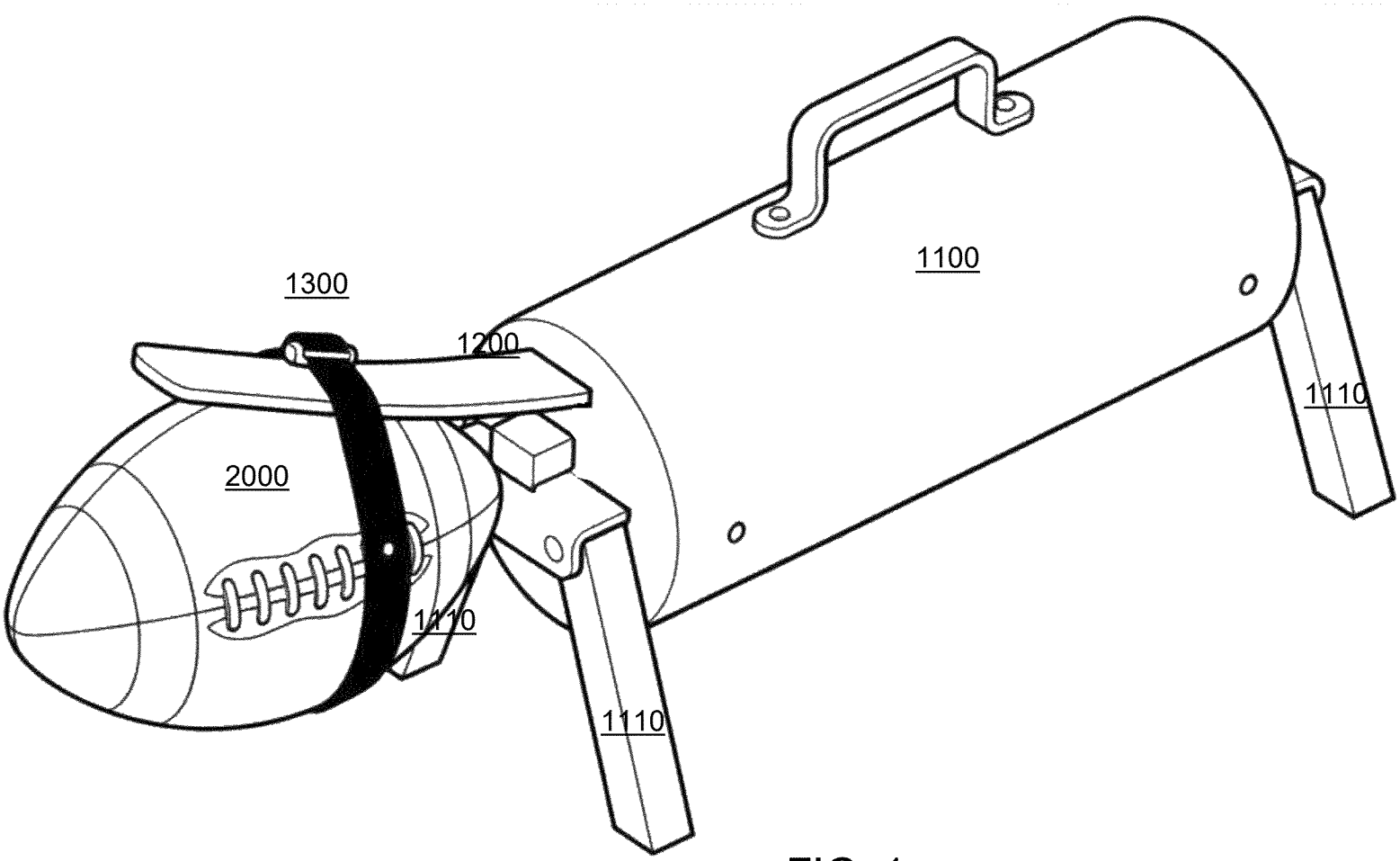
FIG. 1 is a perspective view of the football snap training device 1000 according to the present disclosure, showing the main cylindrical body 1100, the four supporting legs 1110, the neck assembly 1200 in extended position with a football 2000 secured by strap 1300, the carrying handle, and the overall configuration of the device 1000.

Referring now to the drawings, and particularly to FIG. 1, there is shown a perspective view of a preferred embodiment of the football snap training device 1000 according to the present invention. The device comprises a main body 1100 having a generally cylindrical configuration with a longitudinal axis oriented horizontally. The cylindrical body 1100 has a length of approximately 24 to 36 inches and a diameter of approximately 8 to 12 inches, though these dimensions may be varied depending on the capacity of internal components and structural requirements.

Extending downward from the main cylindrical body 1100 are four legs 1110, each fabricated from steel tubing having an outer diameter of approximately 1 inch. The legs 1110 are positioned in a rectangular pattern, with two legs located near the forward end of the body 1100 and two legs located near the rearward end. Each leg 1110 extends downward a sufficient distance to elevate the main body 1100 approximately 12 to 18 inches above the ground surface when the device is positioned for use. The bottom ends of legs 1110 may be fitted with rubber or plastic caps (cleats) to prevent slipping and/or to protect underlying surfaces.

Attached to the top surface of the cylindrical body 1100 may be a carrying handle of conventional U-shaped or D-shaped configuration. The handle is pivotally or fixedly mounted and is positioned centrally along the length of the body 1100 to provide balanced lifting and carrying. The handle facilitates transport of the device, which has a total weight of approximately 25 to 40 pounds depending on battery size and material selections.

Extending from one end of the main body 1100 is a reciprocating neck assembly 1200. The neck assembly 1200 comprises an outer bar portion having an approximate width of 2 inches and the bar extends lengthwise within the housing 1100, allowing the inner part to slide on a baring slide for reduced friction. Alternat embodiments may include a neck 1200 that operates telescopically. The neck assembly 1200 extends in a generally horizontal direction from the body 1100, then bends upward at an angle of approximately 30 to 60 degrees. The upward-bent portion terminates in a distal end section that is oriented to hold a football 2000 at an elevated angle similar to the position of a football held by an offensive center prior to snap.

Secured to the distal end of neck assembly 1200 is a strap 1300 comprising durable nylon webbing or similar material with an adjustable buckle mechanism. The strap 1300 is configured to wrap circumferentially around a regulation football 2000, securing the ball firmly to the neck assembly 1200. When properly secured, the football 2000 is positioned to hover just above ground level at approximately the same height and angle as a football held by an offensive center's hands during the pre-snap stance.

The overall appearance of the device, with its cylindrical body 1100 supported by four legs 1110 and having an extending neck 1200 with attached football 2000, bears resemblance to a turtle with body, four legs, and extended neck, thus inspiring the "Snapping Turtle" nomenclature and tradename.

FIG. 1 provides a preview for using the device. Referring to FIG. 1, to prepare the device for use, a coach or trainer places the device 1000 on a practice field or training surface by supporting it on legs 1110. A regulation football 2000 is secured to neck assembly 1200 using strap 1300, with the buckle tightened to ensure firm attachment. The coach verifies that the telescoping neck 1200 is in its fully extended position and that the football 2000 is properly positioned at the desired height and angle.

One or more defensive players are then positioned on the ball side of the device 1000—that is, the side from which the football 2000 extends. Players assume proper defensive three-point or four-point stance positions with their eyes focused on the football 2000, simulating their positioning relative to an offensive center in game conditions. The spacing between players and the device 1000 should approximate game-realistic distances.

Figure 2:
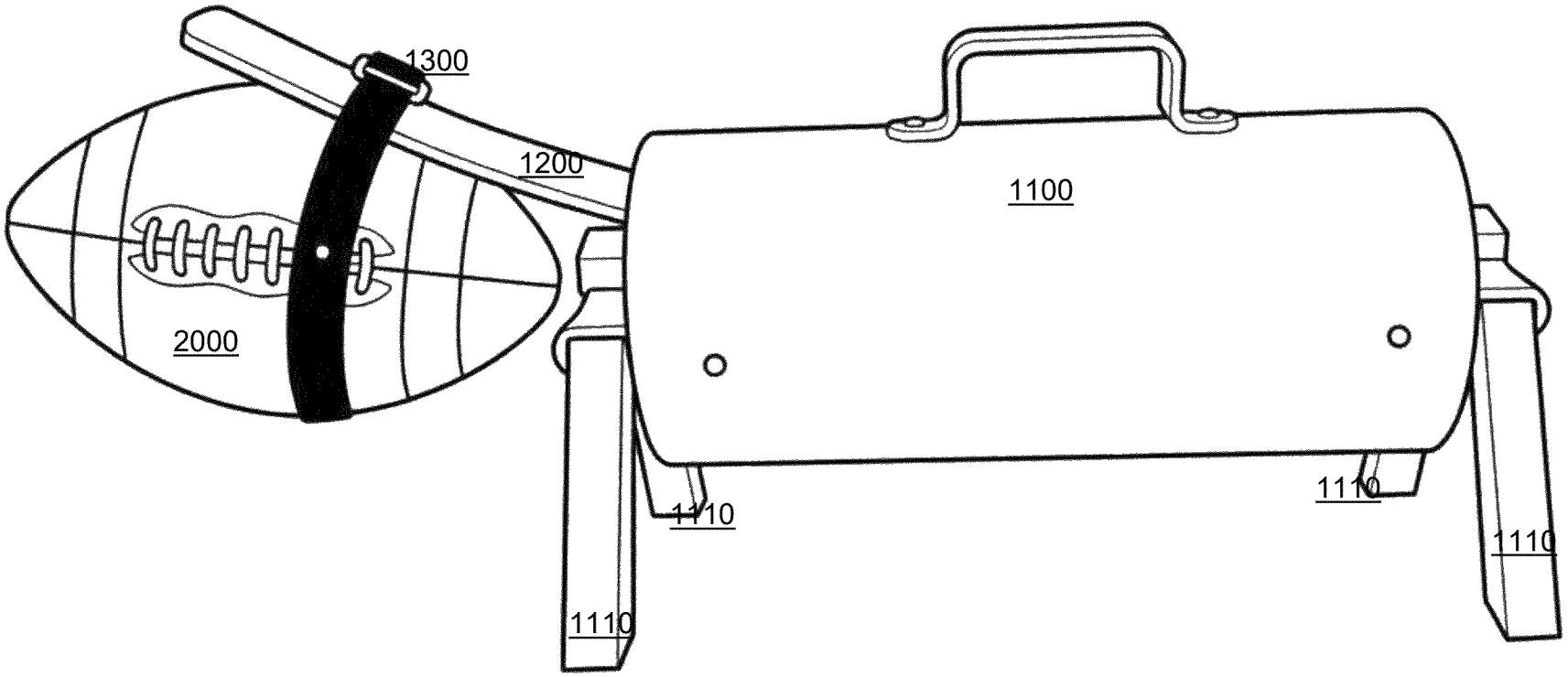
FIG. 2 is a left side elevational view of the device 1000 shown in FIG. 1, illustrating the profile of the main body 1100, the angle of the bent neck assembly 1200, the position of the secured football 2000 relative to ground level, and the spatial relationship between components.

FIG. 2 presents a left side elevational view of the device 1000, providing clear illustration of the spatial relationships between components as viewed from the left side. The cylindrical main body 1100 is shown with its longitudinal axis oriented horizontally and elevated above the ground by legs 1110. Two of the four legs 1110 are visible in this side view—one forward leg and one rearward leg—each extending vertically downward from attachment points on the underside of body 1100.

The telescoping or reciprocating neck assembly 1200 is clearly depicted extending from the forward end of main body 1100. The neck 1200 initially extends in a substantially horizontal direction for a distance of approximately 12 to 18 inches, with transitions through a curved or bent section that angles the distal portion upward at approximately 45 degrees from horizontal. This upward-angled distal section positions the football 2000 at an elevated orientation similar to the angle at which an offensive center holds the ball.

The football 2000 is shown secured to the distal end of neck 1200 by means of strap 1300, which wraps around the circumference of the ball. The strap 1300 is illustrated with sufficient detail to show its attachment points and the buckle mechanism that allows adjustment and secure fastening. When in this extended configuration, the lowest point of the football 2000 hovers approximately 2 to 4 inches above ground level, replicating the position of a football in a center's hands prior to snap.

The profile view of body 1100 shows the carrying handle projecting upward from the top surface of the cylindrical body. Internal components are indicated in phantom lines or hidden line representation, showing the general positioning of the motor 1122, electronic box 1123, and battery 1124 within the body 1100. The spine structure 1120, which comprises the main structural tube running longitudinally through the body 1100, is also implied.

This side view makes clear the biomechanical analogy to a turtle: the cylindrical body 1100 represents the turtle's shell, the four legs 1110 represent the turtle's legs, and the extending bent neck 1200 with attached football 2000 represents the turtle's extended head and neck.

FIG. 2 provides a preview for using the device. With the device positioned as shown in FIG. 2 and defensive players in set positions facing the football 2000, the device is in its ready or pre-activation state. The telescoping neck 1200 is fully extended, displaying the football 2000 in clear view of all positioned players. This static position allows players to focus visually on the football, establishing proper eye discipline and stance positioning.

The coach or trainer, positioned at an optimal viewing location away from the immediate training area, holds a wireless remote control transmitter. The coach observes the players' stance positions, ensuring proper technique before initiating the snap simulation. This pre-activation state may be held for varying durations to train players not to anticipate the snap timing, an important aspect of avoiding false starts and offside penalties.

Figure 3:
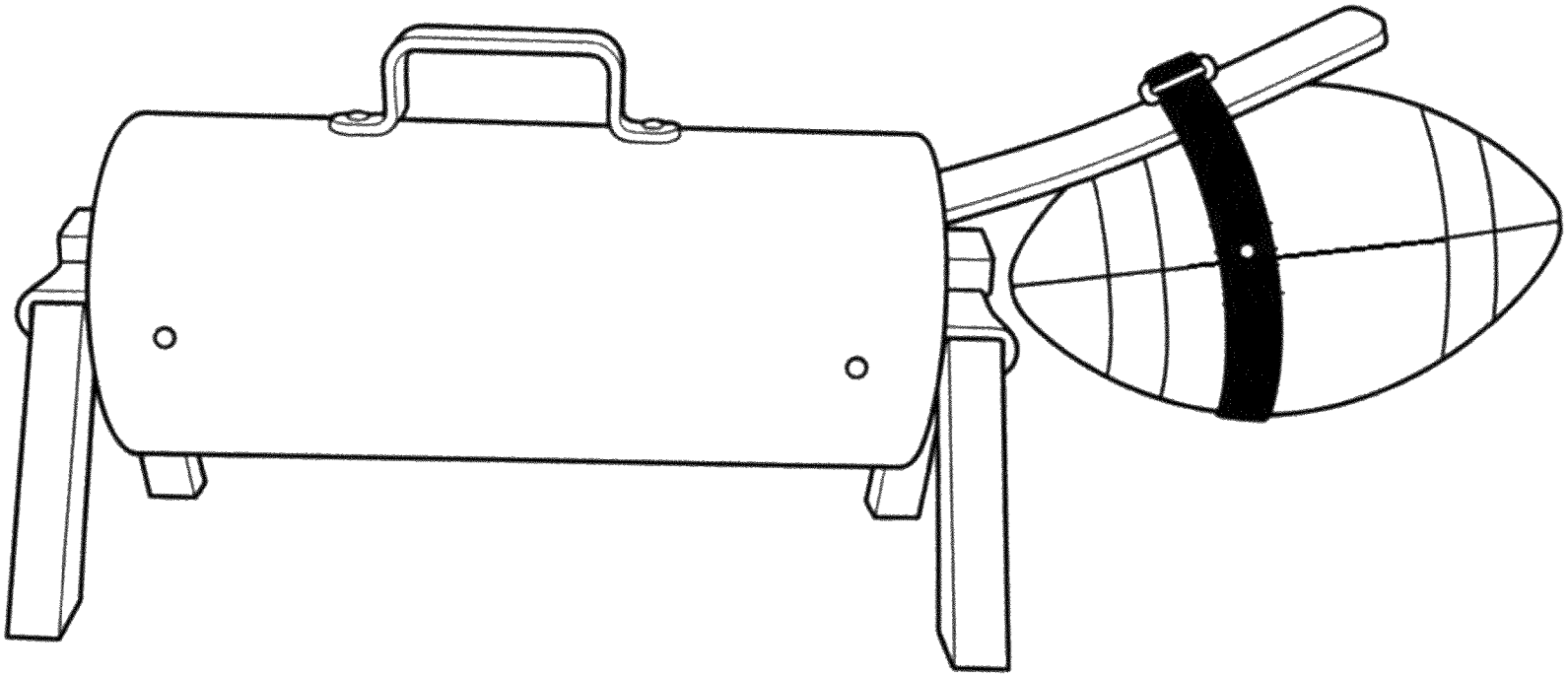
FIG. 3 is a right side elevational view of the device 1000 shown in FIG. 1, providing a mirrored perspective of the side view and showing the symmetrical configuration of the supporting legs 1110 and main body structure 1100.

FIG. 3 provides a right side elevational view of the device 1000, presenting a mirror image of the view shown in FIG. 2. This view confirms the symmetrical configuration of components about the longitudinal centerline of the device. The cylindrical body 1100 is again shown in side profile, elevated by legs 1110 extending downward to ground level.

From this right-side perspective, the two legs 1110 visible in the view demonstrate the consistent spacing and vertical orientation that provides stable support for the body 1100. The spacing between the forward pair of legs and the rearward pair of legs creates a rectangular support base that prevents tipping or tilting during operation.

The telescoping or reciprocating neck assembly 1200 extends from body 1100 with the same configuration as shown in FIG. 2, confirming that the neck structure is centered along the longitudinal axis of the body 1100 rather than offset to either side. The football 2000 secured by strap 1300 occupies the same spatial position relative to ground level, maintaining consistent positioning regardless of viewing angle.

The right-side view perspective illustrates an important training methodology enabled by the device: the ability to position defensive players at various angles around the device 1000. Unlike prior art devices that utilize enclosed housings with limited viewing windows, the present invention's open structural design allows players to be positioned on either side of the device or at angled positions.

This multi-angle capability allows coaches to conduct training drills where multiple defensive linemen or linebackers simultaneously react to the same snap stimulus from different positions. For example, a defensive end positioned to the left of the device (as would be seen by the defensive end in FIG. 2 perspective) and a defensive tackle positioned to the right of the device (as would be seen by the tackle in FIG. 3 perspective) can practice their respective reaction timing and rush angles in coordinated fashion, training unit cohesion in addition to individual reaction speed.

Figure 4:
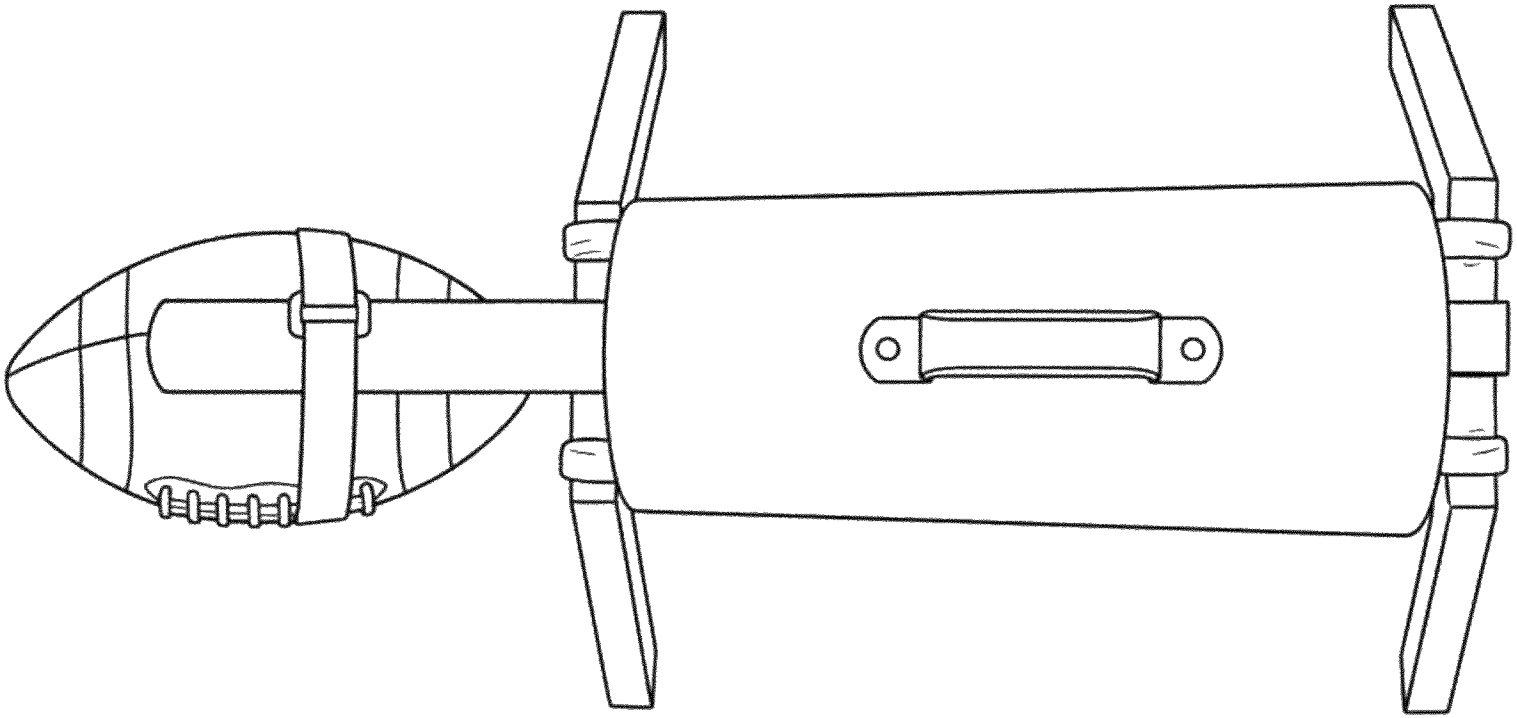
FIG. 4 is a top plan view of the device 1000 shown in FIG. 1, illustrating the top side of the main cylindrical body 1100, the positioning of the four legs 1110 in a rectangular support pattern, the top-mounted carrying handle, and the extending neck 1200 assembly with secured football 2000 via a belt 1300 as viewed from above.

FIG. 4 presents a top plan view of the device 1000, illustrating the configuration of components as viewed from directly above. The main body 1100 is shown with its circular cross-section clearly depicted, confirming the cylindrical nature of the body structure. The outer diameter of body 1100 is clearly visible, and any external features such as seams, access panels, or mounting points for the carrying handle are shown.

The four legs 1110 are positioned in a rectangular pattern, with each leg attached to the underside of body 1100 at a location near one of the four corners of an imaginary rectangle drawn around the body. This rectangular positioning provides maximum stability against tipping in any direction. The spacing between the forward pair of legs 1110 is approximately 18 to 24 inches, and the spacing between the left and right pairs of legs 1110 is approximately equal to the length of body 1100.

The telescoping or reciprocating neck assembly 1200 extends from the forward end of body 1100, and its circular cross-section is visible in plan view. The bend or curve in neck 1200 that angles it upward is difficult to recognize in this top view since the bend occurs in a vertical plane, but an example of the overall length of the neck 1200 from body 1100 to the secured football 2000 is clearly illustrated.

Still referring to FIG. 4, the football 2000 secured by strap 1300 is shown in plan view with its characteristic prolate spheroid shape and lacing visible. The orientation of the football 2000 shows it positioned with its longitudinal axis extending generally parallel to the longitudinal axis of body 1100, though slightly angled upward as dictated by the bend in neck 1200.

The carrying handle is clearly shown projecting upward from the top surface of body 1100, positioned at the approximate center of the body's length to provide balanced carrying. The handle's D-shaped or U-shaped profile is visible, showing the grip portion elevated above the body 1100 by approximately 4 to 6 inches for comfortable hand clearance.

The top view perspective is particularly useful for illustrating proper positioning of the device 1000 relative to defensive players during various training drills. When setting up multiple players in a defensive line formation, the coach uses the top-view orientation to establish proper spacing between players and proper alignment relative to the device's centerline. For example, in a drill simulating a nose tackle position, the device 1000 is positioned with its longitudinal axis perpendicular to the line of scrimmage, and the defensive player positions himself directly facing the extending football 2000. In drills simulating defensive end or outside linebacker positions, the device 1000 may be angled or positioned to allow players to practice rush angles and edge techniques while still reacting to the snap movement of football 2000.

The stable rectangular base formed by legs 1110, as clearly visible in FIG. 4, prevents the device from tipping or shifting even when positioned on uneven field surfaces or when players make contact with the device during aggressive rush techniques.

Figure 5:
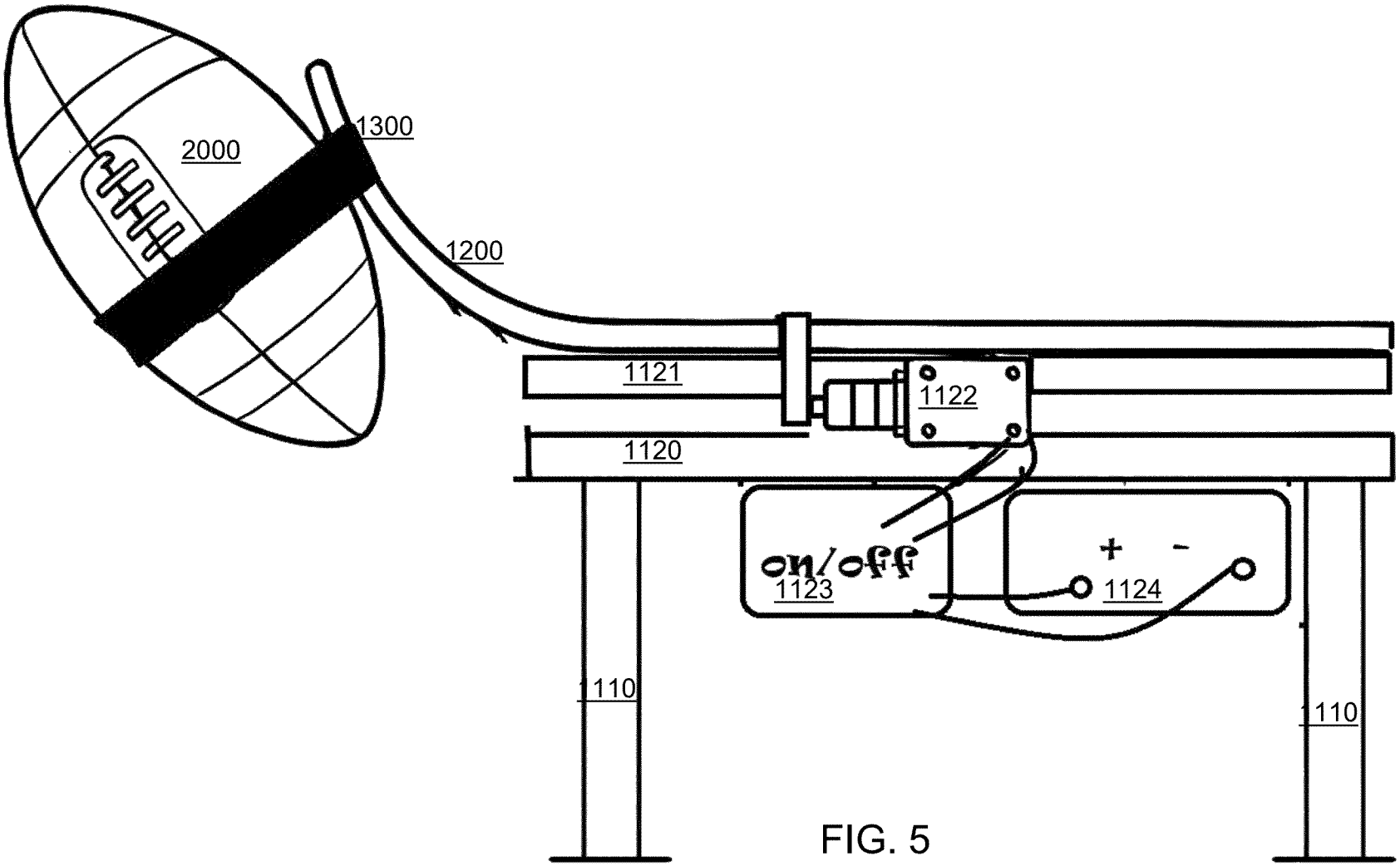
FIG. 5 is a cross-sectional view taken along the longitudinal axis of the device 1000, revealing the internal components including the motor 1122 with piston drive 11220, the electronic box 1123 containing control circuitry, the battery 1124, the bearing slide mechanism 1121 that facilitates reciprocating movement of the neck 1200, the spine structure 1120, and the internal arrangement of components within the main body 1100.

FIG. 5 presents a cross-sectional view taken along the longitudinal centerline of the device 1000, revealing the internal components and mechanisms housed within main body 1100. This cutaway view is useful for understanding the operational mechanics of the invention. This view also illustrates the practical placement of internal components within body 1100. The motor 1122 and associated drive mechanism are centered within the body 1100 to provide balanced weight distribution. The battery 1124 and electronic box 1123 are similarly positioned to maintain the device's center of gravity near the geometric center of the rectangular support base formed by legs 1110.

The cylindrical body 1100 is shown in cross-section, revealing its hollow interior chamber that houses the operating components. The body 1100 may be fabricated from formed sheet metal, molded plastic, or composite materials having sufficient strength and durability to protect internal components while keeping overall weight reasonable for portability.

The spine 1120, comprising a steel tube of approximately 2-inch outer diameter, extends longitudinally through the interior of body 1100, serving as the primary structural backbone of the device. The spine 1120 provides mounting points for internal components and serves as the outer tube of the telescoping neck assembly 1200.

The bearing slide 1121 is shown schematically as a low-friction bearing or sleeve mechanism that allows the neck bar 1200 or inner tube of telescoping neck 1200 to slide smoothly being upheld by the spine 1120. The bearing slide 1121 may comprise ball bearings, bronze bushings, or polymer sleeve bearings designed to minimize friction while maintaining alignment between the neck bar or telescopic concentric tubes.

The motor 1122 is positioned within body 1100 and is shown with its mounting configuration and operative connection to the telescoping mechanism. The motor 1122 is a 12-volt DC motor with sufficient torque output to drive the reciprocating or telescoping motion against the load imposed by the secured football 2000 and air resistance. The motor 1122 is equipped with a piston drive mechanism 11220, which may comprise a linear actuator, lead screw drive, rack-and-pinion mechanism, or hydraulic/pneumatic piston system.

The piston drive 11220 is operatively connected to the inner tube of neck assembly 1200 such that rotation of the motor shaft is converted to linear motion of the inner tube. As the motor 1122 operates, the piston drive 11220 retracts the neck 1200 by sliding along the bearing slide 1121 or telescopically via the inner tube into the outer tube, causing the extending portion of neck 1200 to shorten and draw the secured football 2000 toward body 1100 in a rapid "snapping" motion.

The electronic box 1123 is positioned within body 1100 and contains the control circuitry, wireless receiver module, on/off switch, and associated electronics for operating the device. The electronic box 1123 receives wireless signals from a remote transmitter operated by the coach and processes these signals to control power delivery to motor 1122.

The battery 1124, shown in phantom lines within body 1100, provides 12-volt DC power to operate both the motor 1122 and the electronic components in box 1123. The battery 1124 may be a rechargeable type such as lead-acid, nickel-metal hydride, or lithium-ion, with capacity sufficient for extended practice sessions. Electrical connections between battery 1124, electronic box 1123, and motor 1122 are shown schematically.

The cross-section clearly shows how the neck 1200 extends while supported by the spine 1120 through the end of body 1100. In its extended state (as shown), the neck 1200 projects outward from over the spine 1120, creating the extending neck that holds football 2000. The curved or bent section at the distal end of neck 1200 angles upward to position the football 2000 at the desired elevation and angle.

When the coach activates the remote transmitter or a random activation module is set, the wireless signal or random signal generated is received by the receiver module within electronic box 1123. The control circuitry processes this signal and energizes motor 1122 by connecting battery 1124 to the motor through appropriate switching circuits. The motor 1122 begins rotating, driving the piston mechanism 11220.

As piston drive 11220 operates, it pulls neck assembly 1200 rearward (toward the interior of body 1100), causing the extending portion of neck 1200 to move inward. This retraction occurs rapidly, typically completing within 0.2 to 0.5 seconds as would a standard "live" snap from a center to quarterback. As the neck 1200 retracts, the secured football 2000 moves rapidly in a linear direction toward body 1100 and slightly downward due to the angle of the bent neck section.

This rapid linear movement of the football 2000 closely simulates the motion of a football being snapped by an offensive center—a quick movement away from the line of scrimmage and into the quarterback's hands. Defensive players observing this movement receive authentic visual stimulus that triggers their trained reactive charge, just as they would react to an actual snap in game conditions.

Figure 6:
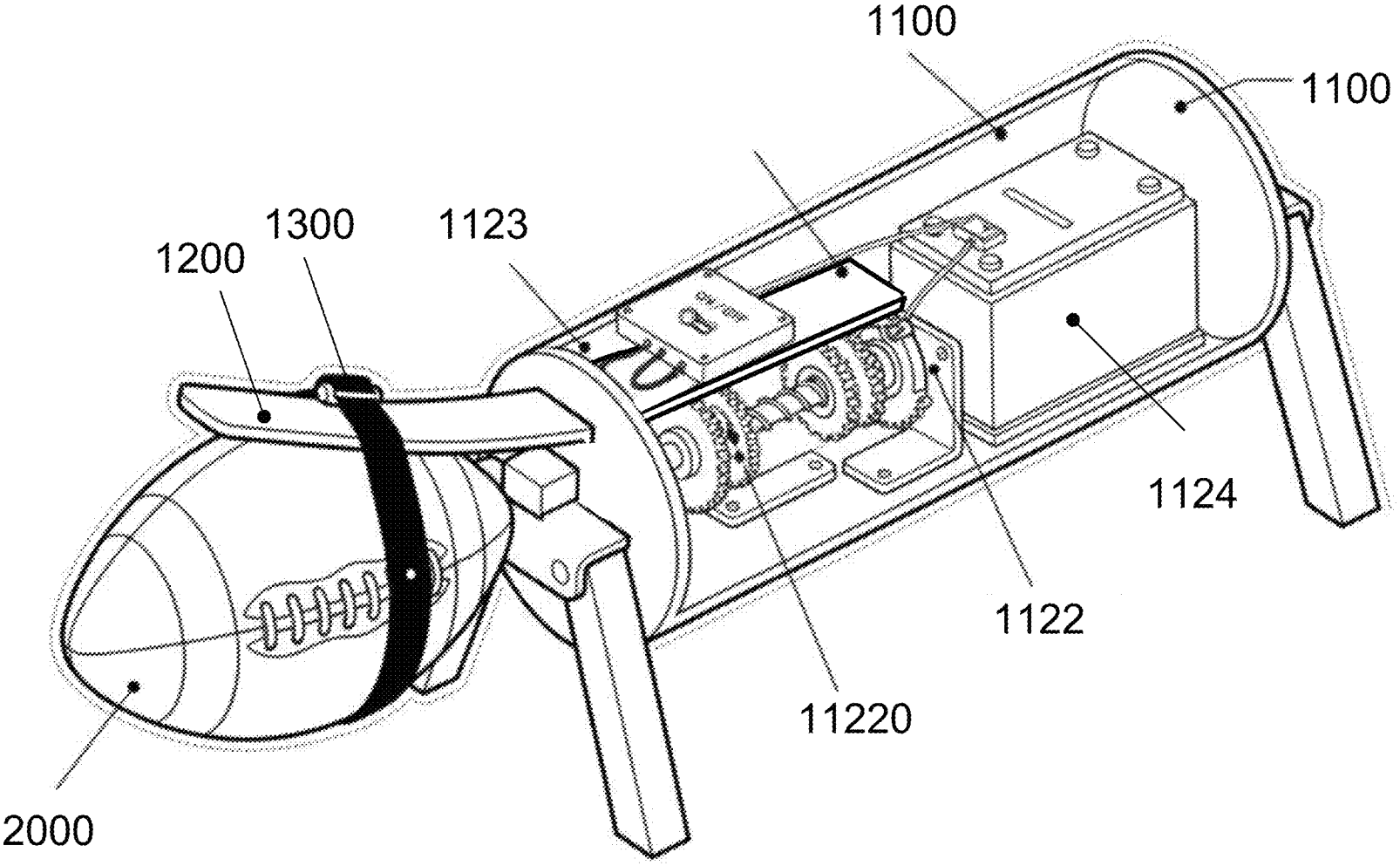
FIG. 6 is a schematic perspective view with partial cutaway of the internal mechanical and electrical components, showing in detail the motor assembly, gear reduction mechanisms, electronic control board, battery positioning, wiring connections, and the mechanical linkage between the motor and telescoping neck assembly.

Overview of FIG. 6—Internal Component Schematic Perspective

FIG. 6 provides a schematic perspective view with portions of body 1100 removed or rendered transparent to reveal internal mechanical and electrical components in greater detail than shown in FIG. 5. This exploded or semi-exploded view illustrates the spatial relationships between components and their mounting configurations.

The motor 1122 is shown with its cylindrical housing and mounting bracket attached to a structural member within body 1100. The motor's output shaft is coupled to a gear reduction mechanism that provides torque multiplication necessary for driving the telescoping or reciprocating mechanism under load. The gear reduction may comprise a planetary gearset, worm gear arrangement, or multi-stage spur gear train enclosed in a compact housing.

The piston drive mechanism 11220 is illustrated in theory, showing for illustration a rotary motion from the motor/gearbox assembly is converted to linear reciprocating motion. If configured as a lead screw system, a threaded rod rotates while a traveling nut attached to the inner tube of neck 1200 converts rotation to linear translation. If configured as a rack-and-pinion system, a rotating pinion gear engages a linear rack attached to the neck 1200. Alternative configurations using cable-and-drum winch systems or hydraulic actuators are also within the scope of the invention.

The electronic box 1123 is shown with its cover removed or transparent, revealing the circuit board containing the wireless receiver module, microcontroller or control logic, power regulation circuits, and motor driver electronics. Connection terminals for battery power input and motor power output are visible. The wireless receiver module may operate on radio frequencies (e.g., 27 MHz, 49 MHz, 2.4 GHz) or infrared wavelengths, with radio frequency being preferred for outdoor use and extended range.

The battery 1124 is illustrated with its terminals and connecting wires to electronic box 1123. If a rechargeable battery type is used, a charging port may be incorporated into the exterior of body 1100 to allow battery recharging without disassembly.

Wiring pathways between components are shown, including power wiring from battery 1124 to electronic box 1123, control wiring from electronic box 1123 to motor 1122, and any sensor wiring if position sensors are incorporated to detect full extension and full retraction positions of neck 1200.

The spine 1120 is shown with the telescoping inner tube of neck 1200 in a partially retracted position (unlike FIG. 5 which shows full extension), demonstrating the range of motion available. The bearing slide 1121 is depicted at the interface between the spine 1120 and the moving neck 1200.

Following activation and retraction of the neck 1200 (snap simulation), the device must be reset to its extended position for the next repetition. This reset may occur automatically or manually depending on the specific embodiment:

Automatic Reset: The motor 1122 may be reversible, allowing the control system to automatically drive the motor in reverse after a programmed delay, extending the neck 1200 back to its home position and returning the football 2000 to its pre-snap position. This automatic reset feature eliminates manual recocking and allows rapid repetition of drills. Spring-Assisted Reset: A tension spring or elastic member may be connected between the body 1100 and the movable portion of neck 1200, storing energy during retraction and automatically extending the neck 1200 when motor power is removed. This provides automatic reset without requiring motor reversibility. Manual Reset: In simpler embodiments, the coach or trainer may manually extend the neck 1200 to its home position between repetitions. While this requires more setup time, it eliminates the complexity and potential failure modes of automatic reset mechanisms. The ability to rapidly reset and repeat the snap simulation allows coaches to conduct high-repetition drills essential for developing muscle memory and reaction speed in defensive players.

Figure 7:
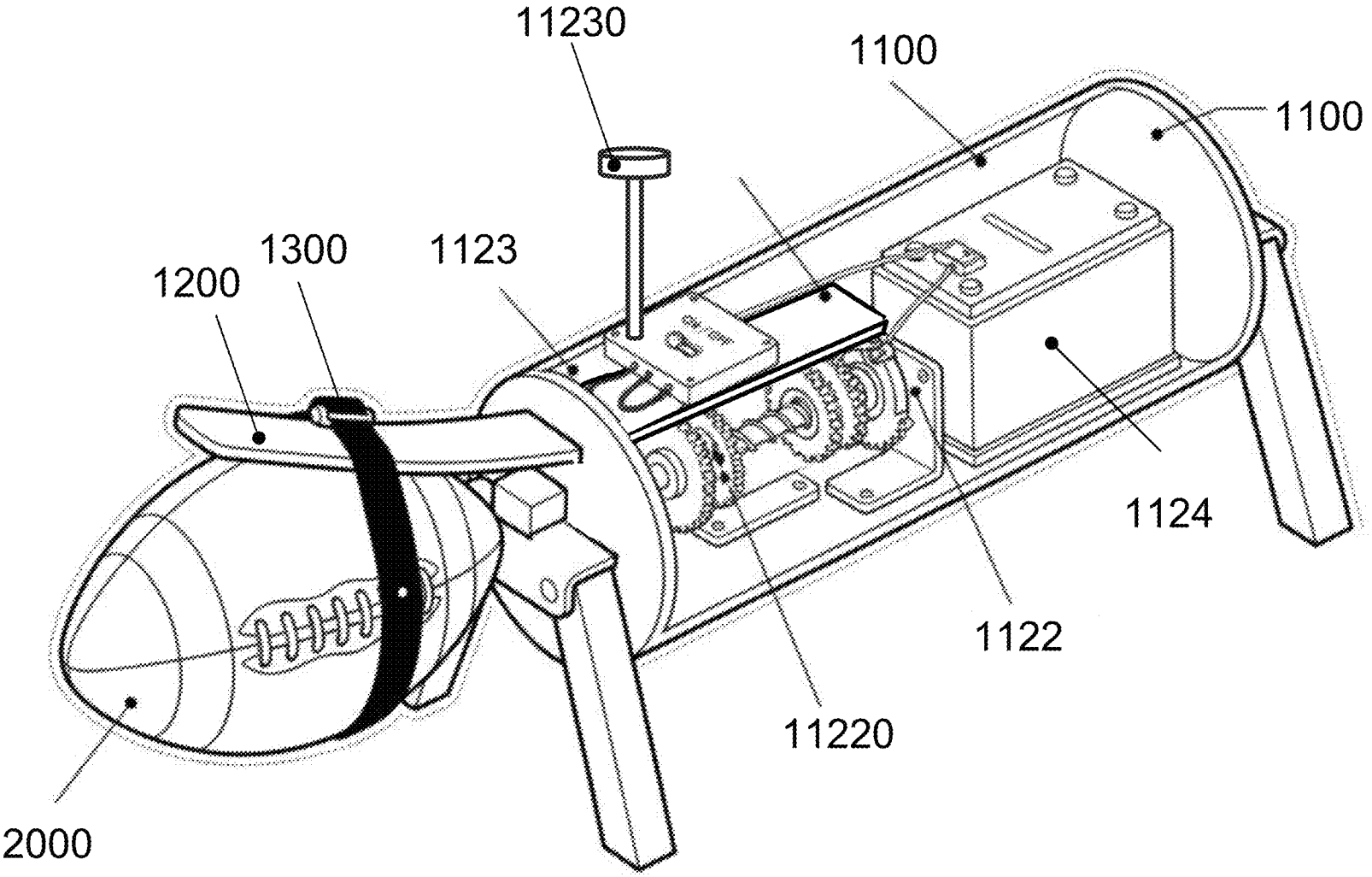
FIG. 7 is a schematic perspective view similar to FIG. 6 but additionally showing a wireless receiver and/or transmitter component 11230 for remote control operation, illustrating the communication pathway between the remote control transmitter and the device's 1000 internal receiver.

FIG. 7 presents a schematic perspective view similar to FIG. 6, but with particular emphasis on the wireless control components. The wireless receiver and/or transmitter module 11230 is prominently illustrated within electronic box 1123. The wireless receiver module 11230 is shown with its antenna connection, power supply connections, and signal output connections to the control circuitry. The receiver

11230 is configured to detect radio frequency or infrared signals transmitted by a handheld remote control unit operated by the coach.

In embodiments where bidirectional communication is desired, the module 11230 includes both receiver and transmitter capabilities. This allows the device 1000 to send acknowledgment signals back to the handheld remote, confirming receipt of commands, reporting battery status, indicating ready/busy states, or transmitting diagnostic information.

The handheld remote control transmitter (not shown in detail but represented schematically or theoretically) is a compact battery-powered device that may be held in one hand by the coach. It includes one or more buttons or switches for triggering the snap simulation, and may include additional controls for adjusting snap speed, programming delay timings, or selecting operating modes (e.g., random snap sequences).

The wireless communication protocol may employ commercially available remote control technology similar to that used for garage door openers, radio-controlled toys, or security systems. Alternatively, more sophisticated protocols such as Bluetooth, WiFi, or proprietary RF protocols may be employed for enhanced range, reliability, and features. The effective range of the wireless control system is preferably at least 15 to 100 feet, allowing the coach to position himself at optimal viewing angles and distances for evaluating player reactions. Greater ranges of 200+ feet may be achieved with higher power transmitters and more sensitive receivers.

During defensive reaction drills, the coach positions himself at a location providing optimal view of the defensive players' stances and reactions. This location is typically 10 to 30 yards away from the device 1000, at a slightly elevated angle if possible (such as standing on a platform or elevated sideline), and positioned to observe all players participating in the drill.

The coach holds the wireless remote transmitter in hand, observing the players' readiness. When satisfied with their set positions, the coach may vary the timing before triggering the snap simulation, training players not to anticipate a rhythmic or predictable snap count. This variable timing is crucial for developing proper discipline and avoiding false starts.

When ready to initiate the snap simulation, the coach presses the activation button on the remote transmitter. The wireless signal travels to the receiver 11230 in electronic box 1123, which processes the signal and triggers motor 1122 to execute the snap motion. The coach simultaneously observes the players' reactions, noting their reaction speed, initial movement direction, and technique.

The wireless remote control feature provides several significant advantages: (1) it allows the coach optimal positioning for evaluation rather than being constrained to stand adjacent to the device, (2) it eliminates trailing wires that could create tripping hazards, (3) it allows operation from protected positions during adverse weather, and (4) it enables the coach to focus attention on players rather than on operating mechanisms.

Figure 8:
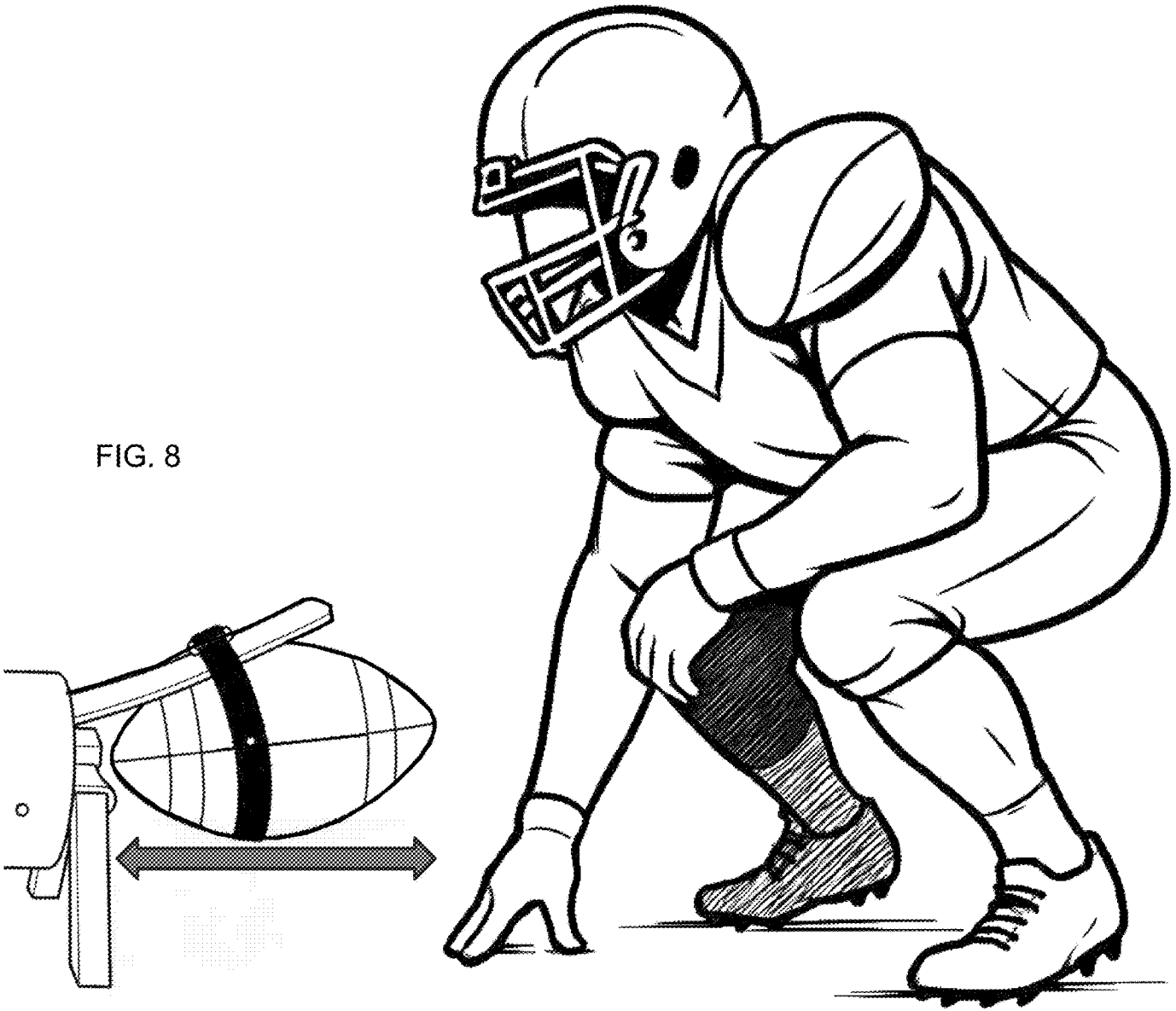
FIG. 8 is an environmental view showing the device 1000 in an idle or ready state with a football player in three-point defensive stance positioned on the ball side of the device 1000, facing the suspended football in a training scenario setup prior to activation.

FIG. 8 presents an environmental view showing the device 1000 in its idle or ready state in an actual training environment. The device is positioned on a practice field or training surface, with grass turf or artificial turf indicated. The four legs 1110 are firmly planted on the ground surface, supporting the cylindrical body 1100 in stable elevated position.

The telescoping or reciprocating neck 1200 is shown in its fully extended position, with the football 2000 secured by strap 1300 and positioned just above ground level. The football 2000 is oriented at its characteristic angle, simulating the position of a ball held by an offensive center.

A football player is shown positioned on the ball side of the device 1000, demonstrating proper defensive alignment. The player is illustrated in a classic three-point stance: feet shoulder-width apart with weight distributed on the balls of the feet, knees bent, hips lowered, back relatively flat, one hand down on the ground for stability, the other hand resting on or near the thigh, head up with eyes focused forward on the football 2000.

The player's positioning relative to the device 1000 demonstrates game-realistic spacing. The player's eyes are locked on the football 2000, training proper visual discipline. The player's down hand is positioned approximately 1 to 2 feet behind the football 2000, simulating the distance between a defensive lineman and the line of scrimmage.

This idle state represents the critical pre-snap moment in actual game play—the defensive player is set in stance, visually focused on the football, mentally alert, and physically primed to react instantaneously to the first movement of the ball. However, the player must remain motionless to avoid an offside penalty, creating the tension between readiness and discipline that the training device helps develop.

The environmental view illustrates a typical defensive reaction drill using the device 1000. The coach begins by positioning the device at an appropriate location on the practice field, using the legs 1110 to firmly stabilize it on the turf. A football 2000 is secured to neck 1200 using strap 1300, with proper tension to ensure the ball remains attached during the snap motion.

The coach then directs defensive players to assume proper set positions facing the device 1000. For individual drills, a single player positions himself as shown in FIG. 8. For unit drills, multiple players may be positioned across the width of a defensive line formation, each with proper spacing and alignment relative to the device 1000.

The coach provides instructions regarding the specific technique or skill focus for the drill: pure reaction timing, explosion off the ball, proper hand placement, maintaining low pad level, pursuing a specific rush angle, or other technical aspects of defensive line play.

Once positioned, players must hold their set stances while the coach observes their form, makes corrections as needed, and prepares to trigger the snap simulation. This holding period, which may vary from 1 to 10 seconds or longer, trains mental discipline and physical stamina in holding proper stance without anticipating the snap.

The coach uses this idle state to evaluate each player's stance quality, eye discipline (ensuring eyes remain focused on the ball), weight distribution, hand position, and overall readiness. These pre-snap fundamentals are as important as reaction speed for successful defensive play.

Figure 9:
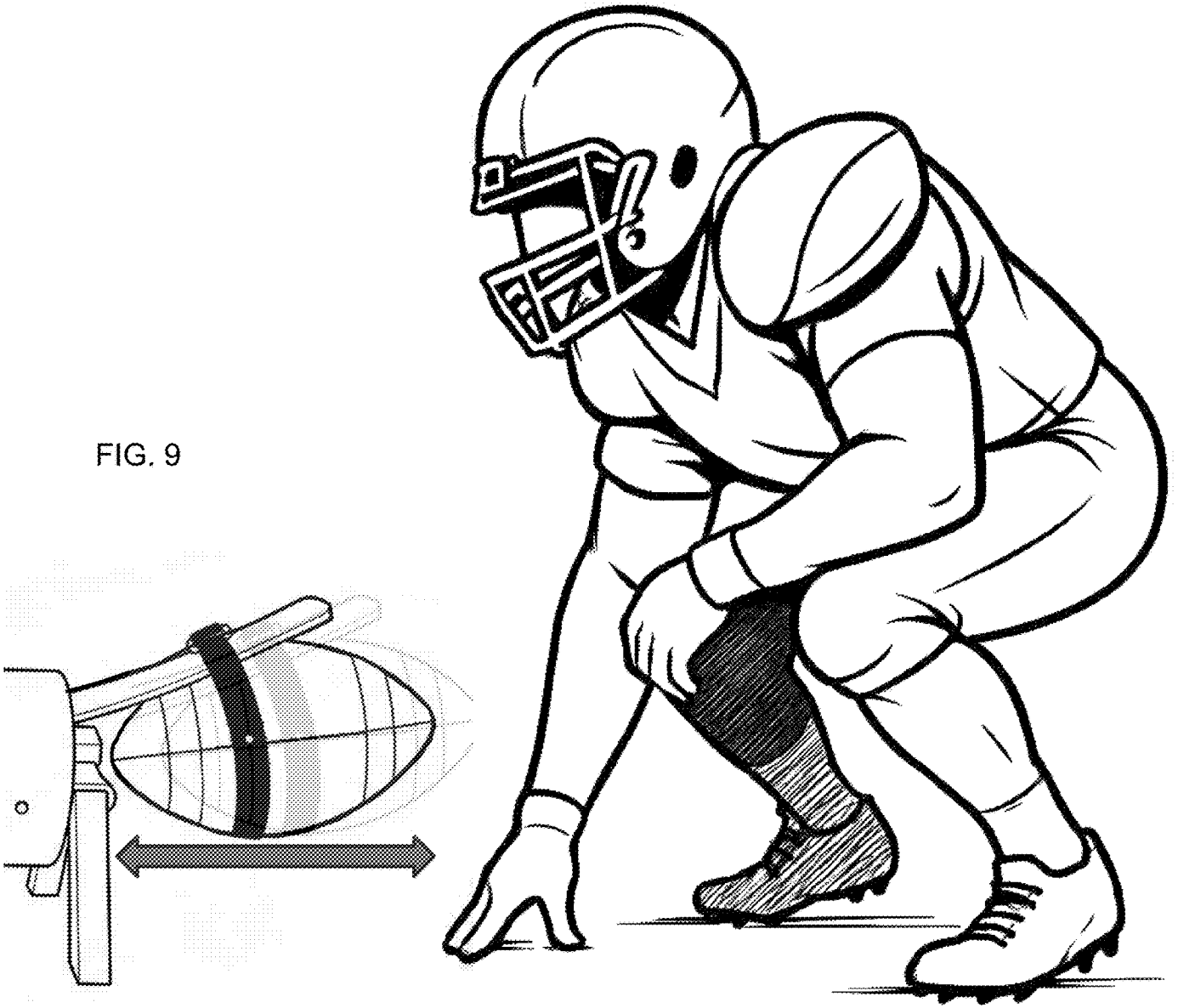
FIG. 9 is an environmental view showing the device 1000 in an active or activated state with motion arrows and multiple-exposer of the football 2000 indicating the direction of telescoping neck 1200 retraction and football 2000 movement, along with the football player beginning his reactive charge in response to the perceived snap movement.

FIG. 9 presents an environmental view showing the device 1000 in its active or activated state, capturing the moment of snap simulation and the player's reactive response. Motion lines, arrows, or other dynamic indicators like multiple exposer effects illustrate the movement of components and the player's reaction.

The telescoping or reciprocating neck 1200 is shown in a partially retracted position, having been drawn inward toward body 1100 by the motor-driven piston mechanism. Motion arrows indicate the direction of retraction—a linear movement of the neck 1200 and secured football 2000 toward and into the cylindrical body 1100. The retraction motion is illustrated occurring in the horizontal and slightly downward direction due to the angle of the bent neck section.

The football 2000, still secured by strap 1300, is shown displaced from its idle position, having moved several inches toward body 1100 in rapid motion. Additional motion indicators such as speed lines or blur effects may be used to convey the rapid nature of the movement.

The defensive player is illustrated in the initial phase of his reactive charge. His down hand has been lifted from the ground, his legs are driving forward and upward, his hips are thrusting forward, and his overall body position shows explosive movement forward toward the device 1000. Motion arrows indicate the direction and vector of the player's charge.

The relative timing is significant: the illustration captures the moment immediately after the initial ball movement, showing the player's reaction time and movement quality in response to the visual stimulus. This visualization demonstrates the training effectiveness of the device—the player's body is reacting to the ball movement exactly as it would in a game situation responding to an actual snap.

The environmental context shows how the drill unfolds in real-world practice conditions, with the player aggressively charging forward while maintaining proper technique, pursuing a rush lane, and demonstrating the explosive "get-off" that characterizes effective defensive line play.

Figure 10:
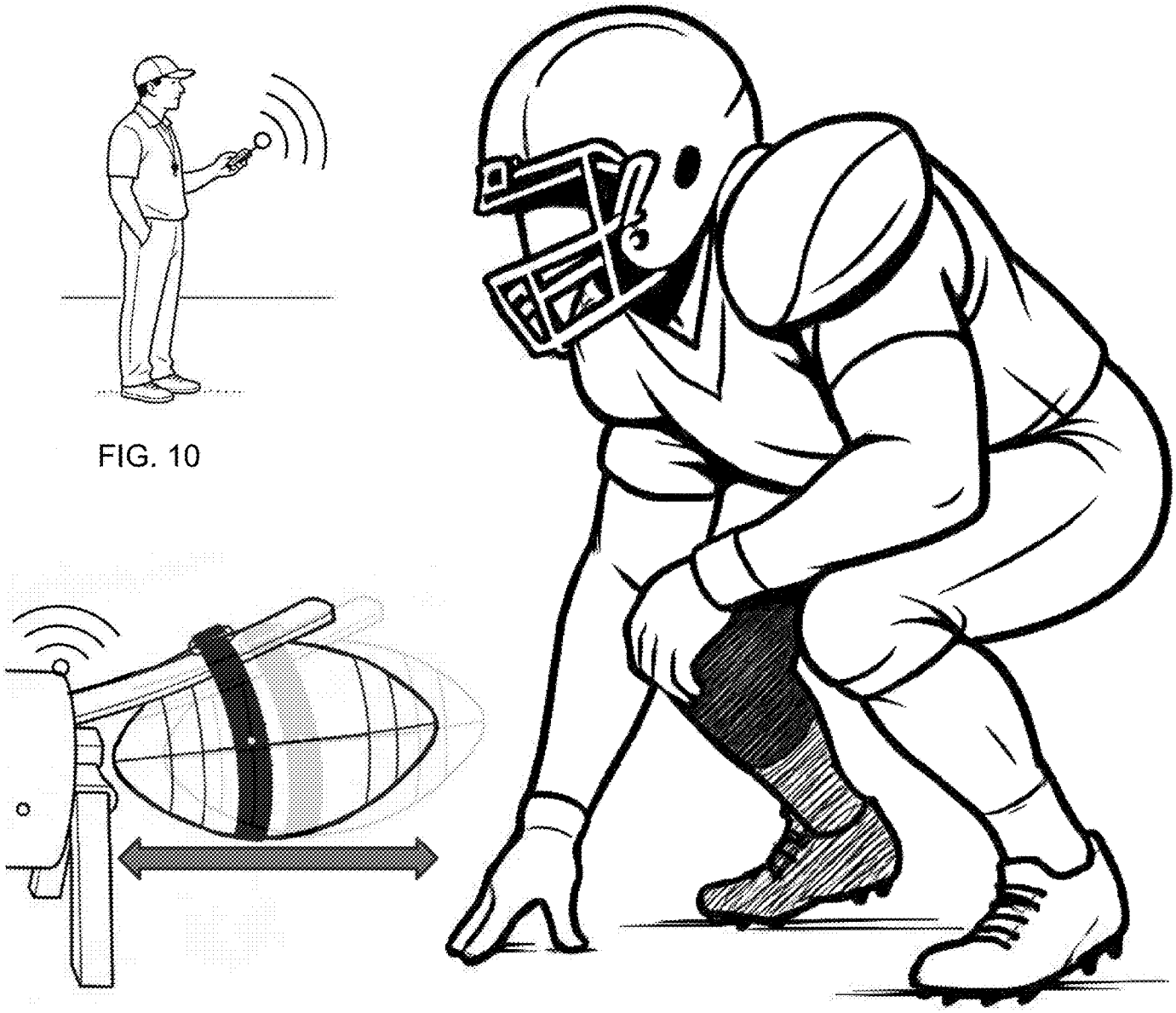
FIG. 10 is an environmental view showing the device 1000 in an active or activated state as triggered by a remote coach with motion arrows and multiple-exposer of the football 2000 indicating the direction of telescoping neck 1200 retraction and football 2000 movement, along with the football player beginning his reactive charge in response to the perceived snap movement.

As shown in FIG. 10, when the coach triggers the remote control transmitter, the wireless signal activates motor 1122 within body 1100. The motor drives the piston mechanism 11220, rapidly retracting the telescoping neck 1200. As the neck 1200 retracts, the secured football 2000 moves in realistic snap-simulating motion-a quick linear movement away from its set position.

Defensive players, with their eyes focused on the football 2000, immediately perceive this movement. Their trained reactive response triggers: they explosively drive forward from their set stances, lifting their down hands, driving with their legs, and executing their assigned rush techniques or pursuit angles.

The coach, observing from his remote position, evaluates each player's reaction:

- Reaction Time: Did the player react immediately to ball movement, or was there perceptible delay?
- False Start Prevention: Did the player avoid premature movement before the ball moved?
- Explosion: Did the player demonstrate proper explosive power in his initial movement?
- Technique: Did the player maintain proper hand position, pad level, and body control during his charge?
- Pursuit Angle: Did the player follow his assigned rush lane or gap responsibility?

The coach can time reaction speeds using a stopwatch or electronic timing system, measuring the elapsed time between ball movement and player movement. Elite defensive linemen typically react within 0.15 to 0.25 seconds of ball movement, and the device 1000 provides a consistent stimulus for developing and measuring this crucial skill.

After evaluating each repetition, the coach resets the device (either automatically or manually depending on embodiment), players return to set positions, and the drill repeats. High-repetition training using the device 1000 develops both the muscle memory for explosive reactions and the mental discipline to avoid premature movement.

Over time, players develop improved reaction timing, better stance fundamentals, enhanced explosion techniques, and stronger mental discipline—all crucial components of effective defensive line play. The realistic movement of an actual football provides training stimulus that closely matches game conditions, leading to better transfer of training benefits to actual competition.

Alternative Embodiments and Variations

While the above detailed description presents a preferred embodiment of the invention, various modifications and alternative configurations are possible within the scope of the inventive concept:

Body Configuration: While a cylindrical body 1100 is described, alternative shapes such as rectangular box configurations, oval cross-sections, or custom-formed housings may be employed while retaining the functional advantages of the invention.

Leg Configuration: While four legs 1110 are shown, alternative support configurations using three legs (tripod), a central pedestal, adjustable-height legs, or ground anchoring stakes may be employed depending on terrain and stability requirements.

Telescoping or Reciprocating Mechanisms: While concentric steel tubes or a bar with bearing slide are described, alternative movement mechanisms using nested square tubing, guided slide rails, accordion-style folding linkages, or cable-and-pulley systems may achieve the extension and retraction functions.

Drive Mechanism: While a motor with piston drive is described, alternative drive systems using solenoid actuators, pneumatic cylinders, hydraulic actuators, elastic spring mechanisms, or electromagnetic linear motors may be employed.

Power Supply: While a 12-volt battery is described, alternative power sources using different voltages, external power connections, solar panels with storage batteries, or hand-cranked mechanical energy storage may be employed.

Ball Securing Mechanism: While a strap with buckle is described, alternative securing mechanisms using clamp assemblies, quick-release catches, elastic cords, hook-and-loop fasteners, or magnetic retention systems may be employed to secure the football 2000.

Wireless Control: While radio frequency wireless control is described, alternative control methods using infrared signals, WiFi connectivity, Bluetooth communication, smartphone app control, or wired remote controls may be employed.

Automatic Features: Various automatic features may be incorporated, including programmable variable or random timing between repetitions, random delay generation to prevent anticipation, automatic drill counting and timing, performance data logging, or integrated sound/voice feedback.

Adjustability: Various adjustable features may be incorporated, including height-adjustable legs for accommodating different age groups or skill levels, adjustable neck angles for varying ball positioning, adjustable retraction speed for different training intensities, or adjustable retraction distance.

All such variations and modifications that achieve the fundamental objective of simulating realistic football snap movement using an actual football with motorized telescoping mechanism are considered within the scope of the present invention.

The present invention provides numerous advantages over prior art football training devices. By using an actual football rather than painted representations, it delivers authentic visual cues that match game conditions, improving training transfer. Its linear telescoping movement accurately simulates the snap of a ball, unlike rotational or arcuate motions seen in earlier designs, and the open structural configuration affords unobstructed 360-degree visibility without walls blocking sight lines. The ball is positioned at true game height and angle to mirror an offensive center's pre-snap hold, while lightweight construction with an integrated handle ensures easy transport and repositioning. A four-leg support structure supplies stability on varied field surfaces, and wireless remote operation lets coaches stand at optimal vantage points, with radio frequency control enabling 50-plus yard range. The device supports rapid reset—automatic or manual—for high-repetition drills essential to skill development and achieves cost effectiveness through simpler construction with standard materials. Robust steel tube framing delivers durability for repeated use and incidental contact, and the apparatus is versatile for individual development, unit coordination, or specialized position work. Weather-resistant materials and sealed electronics support outdoor use, the unit functions independently without integration into blocking sleds, and its "turtle" analogy—neck retracting into body—offers an intuitive biomechanical model that is easily understood and remembered.

The football snap training device of the present invention represents a significant advance over prior art in the field of defensive reaction training equipment. By utilizing an actual football moved in realistic snap-simulating motion through a motorized telescoping mechanism, the device provides training stimulus that closely matches game conditions. The open structural design, wireless remote operation, and portable configuration address the significant limitations of prior art devices while maintaining cost-effectiveness and ease of use.

While the invention has been described with reference to a preferred embodiment and various alternatives, those skilled in the art will recognize that modifications and variations may be made without departing from the spirit and scope of the invention as set forth in the following claims.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus, the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

I claim:

1. A method of operating a football snap training device by a coach, the method comprising: providing the device, said device having a body supported by legs, a neck supporting a regulation football by a securing strap, and a motorized linear drive coupled to the neck; positioning the device in a vicinity of the coach arming control electronics of the device; transmitting, from a coach-held wireless transmitter, an activation signal to the device; in response to the activation signal, energizing the motorized linear drive to retract the neck toward the body so that the secured football moves in a snap-simulating linear motion; and after the motion, returning the neck to an extended ready state for a subsequent repetition.

2. A method of operating a football snap training device by a player in a random-timing mode, the method comprising: providing the device, said device having a regulation football secured to a distal end of a retractable neck is visible to the player, and a motorized linear drive coupled to the neck; positioning the device in a vicinity of the player; selecting at the device, by the player, a random-timing operating mode of control electronics; arming the device and assuming a ready stance; generating, by the control electronics, a randomized delay within a preset window; automatically energizing the motorized linear drive upon expiration of the randomized delay to retract the neck and move the football in snap-simulating motion; and after the motion, returning the neck to an extended ready state for a subsequent repetition.

* * * * *